US008500423B2

(12) United States Patent
Sakurai et al.

(10) Patent No.: US 8,500,423 B2
(45) Date of Patent: Aug. 6, 2013

(54) FRAME ROTATED HYDRAULIC MOTOR WITH IMPROVED PARKING BRAKE

(75) Inventors: Hisatoshi Sakurai, Kameoka (JP); Yasukazu Mishima, Kameoka (JP)

(73) Assignee: Eaton Corporation, Cleveland, OH (US)

( * ) Notice: Subject to any disclaimer, the term of this patent is extended or adjusted under 35 U.S.C. 154(b) by 644 days.

(21) Appl. No.: 12/759,052

(22) Filed: Apr. 13, 2010

(65) Prior Publication Data

US 2011/0250086 A1 Oct. 13, 2011

(51) Int. Cl.
*F03C 2/08* (2006.01)
*F04C 15/00* (2006.01)

(52) U.S. Cl.
USPC ..... 418/61.3; 188/170; 242/268; 318/34; 418/69; 418/166; 418/171; 418/181; 418/131; 418/132

(58) Field of Classification Search
USPC ..... 188/170; 242/268; 318/34; 418/61.3, 418/69, 166, 171, 181, 131, 132
See application file for complete search history.

(56) References Cited

U.S. PATENT DOCUMENTS

| | | | | |
|---|---|---|---|---|
| 3,894,821 | A * | 7/1975 | White, Jr. | 418/133 |
| 4,445,423 | A * | 5/1984 | Louhio | 91/492 |
| 4,597,476 | A | 7/1986 | Wenker | |
| 5,022,837 | A * | 6/1991 | King et al. | 418/132 |
| 5,100,310 | A * | 3/1992 | Uppal | 418/61.3 |
| 6,062,835 | A | 5/2000 | Acharya et al. | |
| 6,132,194 | A * | 10/2000 | Wenker et al. | 418/61.3 |
| 6,743,002 | B1 * | 6/2004 | Millar et al. | 418/61.3 |
| 7,287,969 | B2 | 10/2007 | Fugle | |
| 2008/0240959 | A1 * | 10/2008 | Fukuchi et al. | 418/61.3 |

FOREIGN PATENT DOCUMENTS

| | | | |
|---|---|---|---|
| JP | 59153983 | A * | 9/1984 |
| JP | 2001082313 | A * | 3/2001 |

* cited by examiner

*Primary Examiner* — Kenneth Bomberg
*Assistant Examiner* — Jason T Newton
(74) *Attorney, Agent, or Firm* — Quinn Law Group, PLLC

(57) ABSTRACT

A rotary fluid pressure device includes a gerotor gear set having a ring gear and a star gear orbitally moveable about a longitudinal axis relative to the ring gear. The star gear includes an annular spacer ring disposed at one end of the star gear. A brake pin is moveable along the longitudinal axis into and out of interlocking engagement with the annular spacer ring. The brake pin includes an outer surface for engaging an interior surface of the spacer ring. The outer surface of the brake pin and the interior surface of the spacer ring are each angled relative to the longitudinal axis to engage each other in a tapered engagement, to generate an axial force along the longitudinal axis to move the brake pin out of engagement with the star gear in response to a torque being applied to the star gear.

20 Claims, 3 Drawing Sheets

FRAME ROTATED HYDRAULIC MOTOR WITH IMPROVED PARKING BRAKE

TECHNICAL FIELD

The invention generally relates to rotary fluid pressure devices, and more specifically to a brake for rotary fluid pressure devices including a gerotor gear set.

BACKGROUND OF THE INVENTION

Many rotary fluid pressure devices, such as hydraulic motors or hydraulic pumps, include a gerotor gear set. Typically, the rotary fluid pressure device includes a parking brake, i.e., a lock, to prevent torque transfer, i.e., rotation of the gerotor gear set.

There are many different styles of parking brakes for the gerotor gear set, however, one particular style of parking brake includes a brake pin that is longitudinally moveable along a longitudinal axis into interlocking engagement with a star gear of the gerotor gear set. The brake pin includes a cylindrical portion that slides into an internal opening of the star gear to prevent orbital movement of the star gear about the longitudinal axis. The cylindrical portion of the brake pin engages the internal opening of the star gear in a parallel arrangement along the longitudinal axis. A torque applied to the star gear generates a radial force that is directed inward toward the longitudinal axis. The brake pin resists this radial force and prevents movement of the star gear. However, in the event an overload is applied to the star gear, i.e., a torque greater than an allowable design torque, the interface between the cylindrical portion of the brake pin and the star gear, i.e., the surface of the brake pin and the surface of the star gear, may be damaged. If the overload is great enough, the brake pin and/or the star gear may fracture.

SUMMARY OF THE INVENTION

A rotary fluid pressure device is disclosed. The rotary fluid pressure device includes a housing and a ring gear attached to the housing. The ring gear defines an interior extending along a longitudinal axis. The ring gear includes a plurality of internal teeth extending radially inward into the interior. The rotary fluid pressure device further includes a star gear. The star gear is eccentrically disposed relative to the longitudinal axis within the interior of the ring gear for orbital movement about the longitudinal axis. The star gear includes a plurality of external teeth extending radially outward into engagement with the internal teeth of the ring gear. The star gear defines an internal opening. The rotary fluid pressure device further includes a spacer ring. The spacer ring is attached to the star gear. The star gear is disposed within the internal opening of the star gear adjacent an end surface of the star gear for orbital movement with the star gear about the longitudinal axis. The rotary fluid pressure device further includes a brake pin coupled to the housing. The brake pin is longitudinally moveable along the longitudinal axis between a locked position and an unlocked position. The brake pin is in interlocking engagement with the spacer ring to prevent the orbital movement of the spacer ring and the star gear when in the locked position. The brake pin is disengaged from the spacer ring to permit the orbital movement of the spacer ring and the star gear when in the unlocked position. The rotary fluid pressure device further includes a biasing device. The biasing device is coupled to the brake pin, and is configured for biasing the brake pin into the locked position. The spacer ring includes an interior surface extending along and angled relative to the longitudinal axis at a taper angle. The interior surface of the spacer ring defines a frustoconical taper opening toward the brake pin. The brake pin includes an outer surface extending along and angled inward toward the longitudinal axis at the taper angle. The outer surface of the brake pin defines a frustoconical surface narrowing toward the spacer ring for engaging the interior surface of the spacer ring in a tapered engagement. The tapered engagement generates an axial force along the longitudinal axis sufficient to compress the biasing device and move the brake pin into the unlocked position in response to a torque applied to the star gear having a magnitude greater than a pre-defined value.

Accordingly, the brake pin of the disclosed rotary fluid pressure device may be disengaged, i.e., moved from the locked position into the unlocked position, by an overload applied to the star gear, i.e., a torque having a magnitude greater than a pre-defined allowed level. In the event an overload is applied to the star gear, the tapered engagement generates both a radial force acting toward the longitudinal axis and an axial force acting along the longitudinal axis. When the axial component of the force generated by the overload torque is greater than the resisting force provided from the biasing device, the axial force moves the brake pin into the unlocked position, thereby allowing the star gear to rotate and preventing damage to either the brake pin and/or the star gear.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Referring to the Figures, wherein like numerals indicate like parts throughout the several views, a rotary fluid pressure device is shown generally at 20. As shown in the Figures, the rotary fluid pressure device 20 includes a hydraulic motor. However, the rotary fluid pressure device 20 may alternatively include a hydraulic pump or some other device not shown or described herein.

Figure 1:
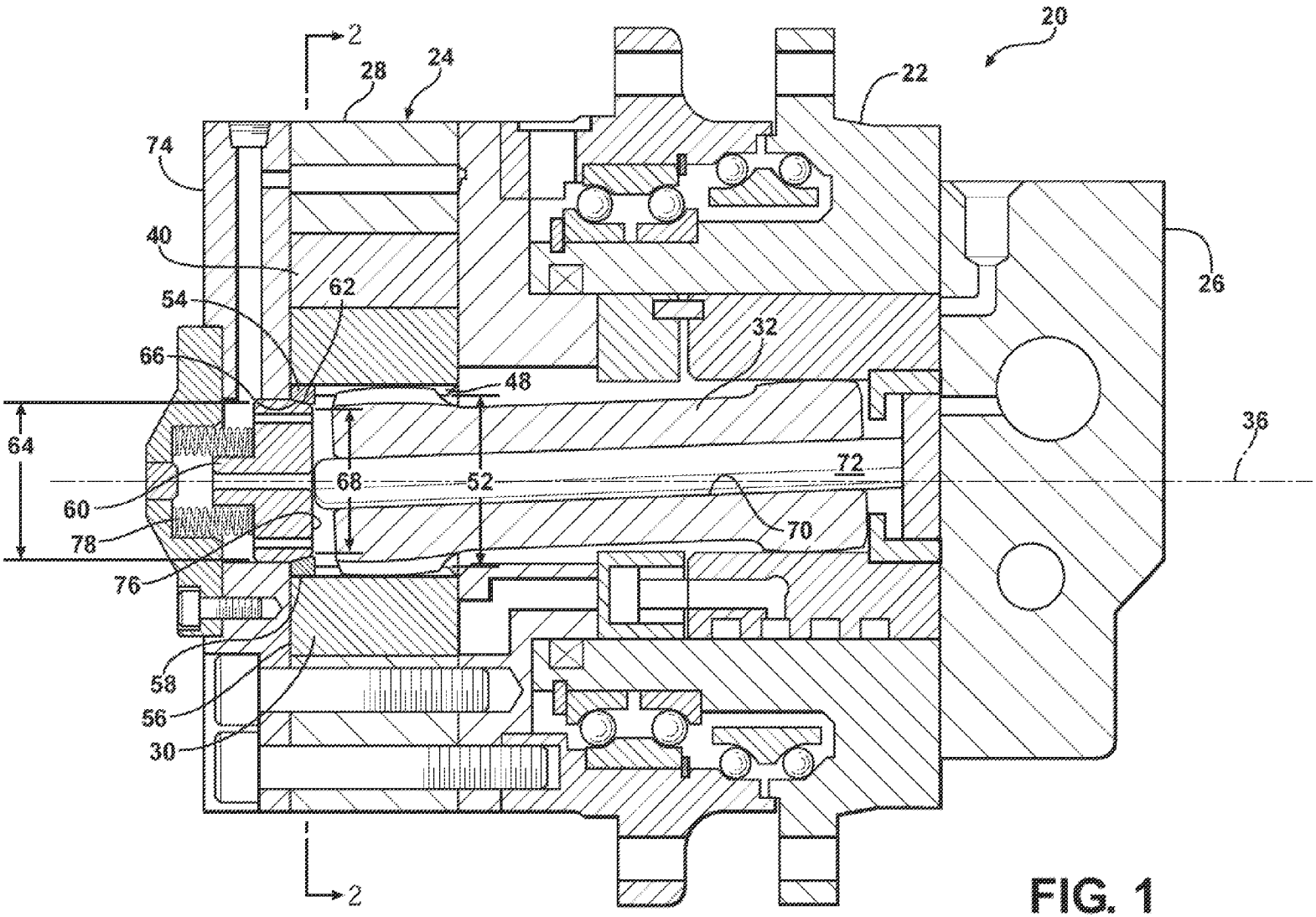
FIG. 1 is a schematic longitudinal cross sectional view of a rotary fluid pressure device.
Figure 2:
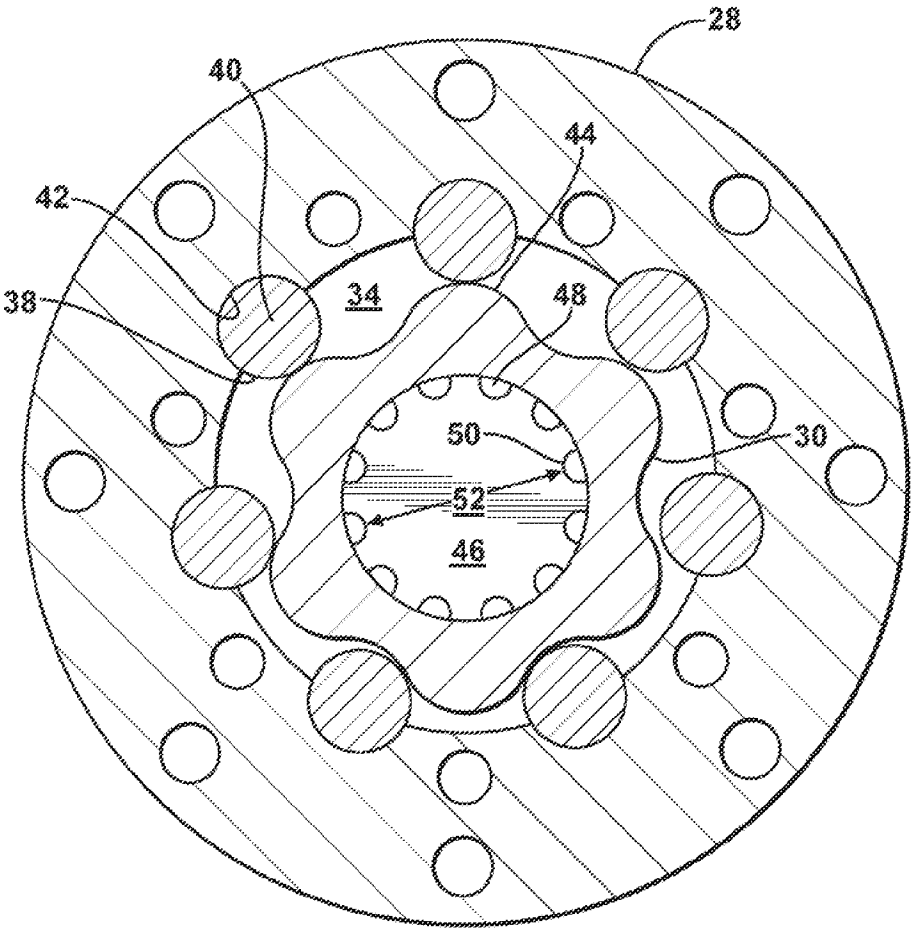
FIG. 2 is a schematic transverse cross sectional view of the rotary fluid pressure device taken along cut line 2-2 shown in FIG. 1.

As shown with reference to FIGS. 1 and 2, the rotary fluid pressure device 20 includes a housing 22, a gerotor gear set 24 and a valve body 26. The housing 22 may include any suitable size and/or shape suitable for the intended purpose. The gerotor gear set 24 operates as is known in the art, and includes a ring gear 28 and a star gear 30 in meshing engagement with each other. The housing 22 supports a shaft 32, which is in meshing engagement with the star gear 30. The star gear 30 and the shaft 32 transmit a torque, i.e., rotation, therebetween.

The ring gear 28 is attached to the housing 22. The ring gear 28 may be attached in any suitable manner, including but not limited to, a plurality of fasteners extending through the ring gear 28 into threaded engagement with the housing 22. The ring gear 28 defines an interior 34, which extends along a longitudinal axis 36. The ring gear 28 includes a plurality of internal teeth 38 extending radially inward into the interior 34, toward the longitudinal axis 36. As is known in the art, the plurality of teeth may include a plurality of rollers 40, with each of the rollers 40 set into and rotatably supported by a semi-cylindrical recess 42. Alternatively, the plurality of teeth may be integrally formed with the ring gear 28.

The star gear 30 is eccentrically disposed relative to the longitudinal axis 36 within the interior 34 of the ring gear 28. The star gear 30 orbits about the longitudinal axis 36, i.e., orbital movement, as is know in the art. The star gear 30 includes a plurality of external teeth 44 extending radially outward, radial away from the longitudinal axis 36, into meshing engagement with the internal teeth 38 of the ring gear 28. The star gear 30 defines an internal opening 46 extending through a center of the star gear 30.

The star gear 30 includes a plurality of internal splines 48. The internal splines 48 are disposed within the internal opening 46 of the star gear 30. The internal splines 48 mesh with a plurality of exterior splines on the shaft 32 to interconnect the star gear 30 and the shaft 32. The internal splines 48 each extend from the internal opening 46 inward toward a distal edge 50 of the internal spline. The internal splines 48 define a spline diameter 52 extending across the internal opening 46, between the distal edges 50 of the internal splines 48.

The internal opening 46 of the star gear 30 defines an annular notch 54 disposed adjacent an end surface 56 of the star gear 30. The annular notch 54 extends into the star gear 30, along the longitudinal axis 36.

The star gear 30 includes a spacer ring 58, which is attached to the star gear 30. The spacer ring 58 is disposed within the internal opening 46 of the star gear 30 adjacent the end surface 56 of the star gear 30. More specifically, the annular ring is disposed within the annular notch 54 of the star gear 30. The annular ring moves orbitally, i.e., orbital movement, with the star gear 30 about the longitudinal axis 36.

Figure 4:
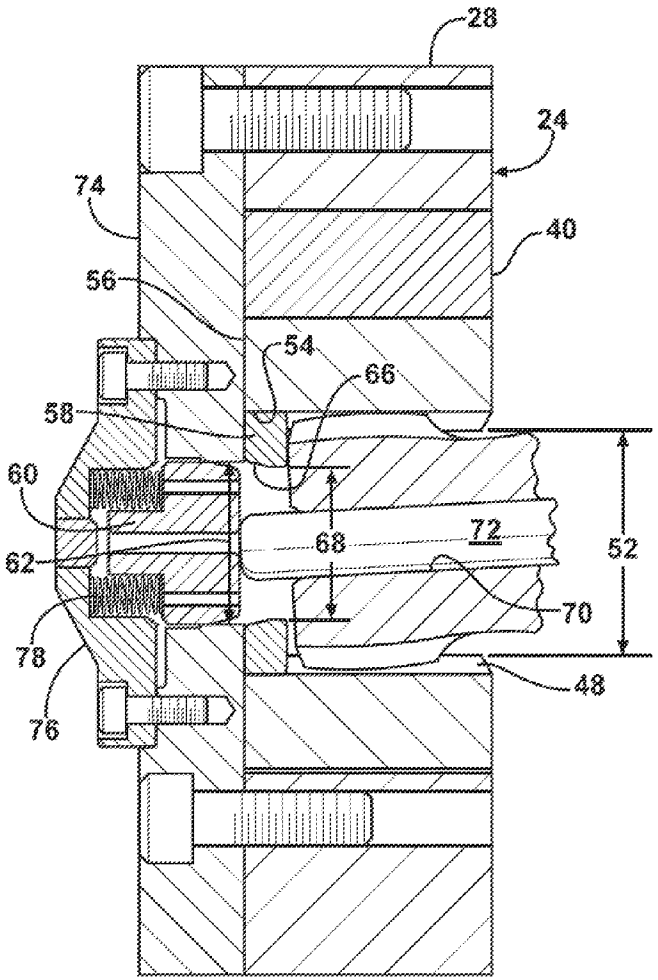
FIG. 4 is an enlarged schematic fragmentary cross sectional view of the rotary fluid pressure device showing the brake pin in an unlocked position
Figure 3:
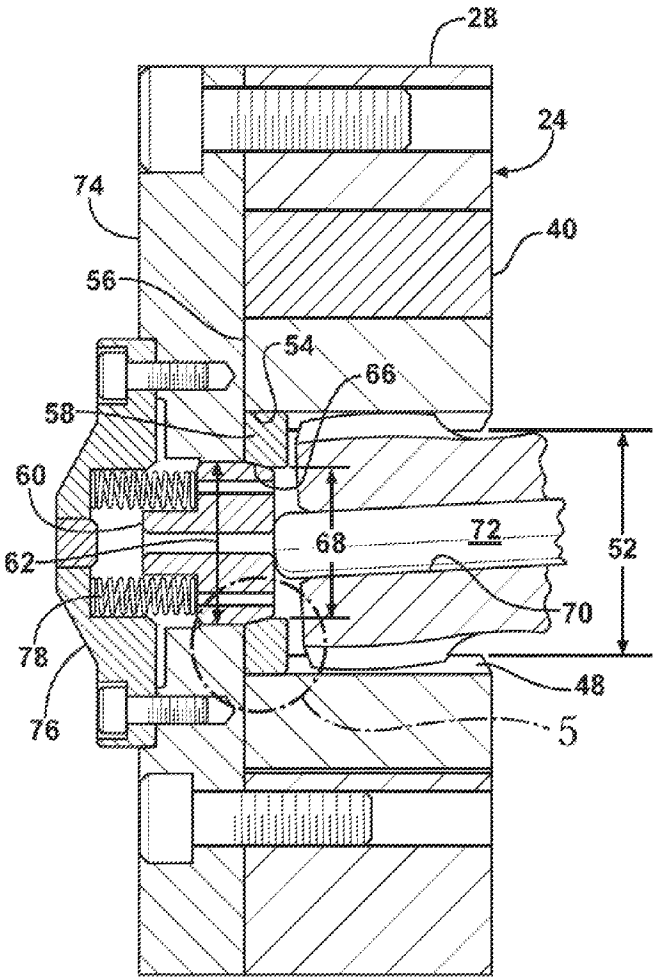
FIG. 3 is an enlarged schematic fragmentary cross sectional view of the rotary fluid pressure device showing a brake pin in a locked position.

The rotary fluid pressure device 20 further includes a brake pin 60. The brake pin 60 is coupled to the housing 22, and is longitudinally moveable along the longitudinal axis 36 into and out of the internal opening 46 of the star gear 30, between a locked position, shown in FIG. 3, and an unlocked position, shown in FIG. 4. When in the locked position, the brake pin 60 is in interlocking engagement with the spacer ring 58 to prevent the orbital movement of the spacer ring 58 and the star gear 30. When in the unlocked position, the brake pin 60 is disengaged from the spacer ring 58 to permit the orbital movement of the spacer ring 58 and the star gear 30.

The brake pin 60 includes an outer surface 62 that defines an outer diameter 64, and the spacer ring 58 includes an interior surface 66 that defines an interior diameter 68. The interior diameter 68 of the interior surface 66 of the spacer ring 58 is less than the spline diameter 52 of the star gear 30. Accordingly, the outer surface 62 of the brake pin 60 is smaller than the spline diameter 52. As such, the brake pin 60 is spaced from the internal splines 48 of the star gear 30 to prevent damage to the internal splines 48 as the brake pin 60 moves into and out of engagement with the internal opening 46 of the star gear 30.

As shown, the shaft 32 defines a bore 70 extending longitudinal through the shaft 32. A brake rod 72 is moveably disposed within the bore 70. The brake rod 72 includes an end in abutting engagement within the brake pin 60. The brake rod 72 is configured for moving the brake pin 60 between the locked position and the unlocked position.

The valve body 26 is attached to the housing 22, and is configured for controlling the operation of the shaft 32 and the brake rod 72. The valve body 26 includes a control system for controlling fluid flow. The valve body 26 may include, but is not limited to, one or more spool valves or the like for controlling fluid flow from the valve body 26 to the housing 22. The specific type and operation of the valve body 26 is not essential to the operation of the subject invention, and is therefore not described in detail herein. The movement of the shaft 32 and the brake pin 60 are controlled by the fluid flow from the valve body 26 as is known in the art. Accordingly, when signaled by the valve body 26, the brake rod 72 pushes against the brake pin 60 to move the brake pin 60 into the unlocked position, out of interlocking engagement with the spacer ring 58, thereby permitting the orbital movement of the star gear 30 about the longitudinal axis 36 relative to the ring gear 28. Similarly, when signaled by the valve body 26, the brake rod 72 retracts into the bore 70 of the shaft 32, permitting the brake pin 60 to move into interlocking engagement with the spacer ring 58, thereby preventing the orbital movement of the star gear 30 about the longitudinal axis 36 relative to the ring gear 28.

The rotary fluid pressure device 20 further includes a gear cover 74. The gear cover 74 is coupled to the ring gear 28. The gear cover 74 may be coupled to the ring gear 28, for example, by a plurality of fasteners extending through the gear cover 74 and into threaded engagement with the ring gear 28 and/or the housing 22. However, it should be appreciated that the gear cover 74 may be attached to the ring gear 28 in some other manner not described herein. The gear cover 74 is configured for securing the ring gear 28 and the star gear 30 to the housing 22.

The rotary fluid pressure device 20 further includes a brake pin cover 76 attached to the gear cover 74. The spacer ring 58 is secured between the plurality of internal splines 48 of the star gear 30 and the gear cover 74.

The rotary fluid pressure device 20 further includes a biasing device 78. The biasing device 78 is coupled to the brake pin 60, and is configured for biasing the brake pin 60 into the locked position. The brake pin cover 76 secures the biasing device 78 relative to the brake pin 60, with the biasing device 78 biasing against the brake pin cover 76. Preferably, the biasing device 78 includes at least one spring disposed between the brake pin cover 76 and the brake pin 60. However, it should be appreciated that the biasing device 78 may include some other type of device capable of biasing the brake pin 60 into the locked position.

As noted above, the spacer ring 58 includes an interior surface 66. The interior surface 66 of the spacer ring 58 extends along and is angled relative to the longitudinal axis 36. The interior surface 66 of the spacer ring 58 is angled relative to the longitudinal axis 36 at a taper angle 80 (shown in FIG. 5) to define a frustoconical taper, which opens toward the brake pin 60. Accordingly, the frustoconical taper of the spacer ring 58 increases in size along the longitudinal axis 36 in a direction moving toward the brake pin 60.

As noted above, the brake pin 60 includes an outer surface 62. The outer surface 62 extends along and is angled inward toward the longitudinal axis 36 at the taper angle 80. The outer surface 62 of the brake pin 60 is angled at the taper angle 80 to define a frustoconical surface that narrows toward the spacer ring 58. Accordingly, the frustoconical surface of the brake pin 60 decreases in size along the longitudinal axis 36 in a direction moving toward the spacer ring 58. The outer surface 62 of the brake pin 60 engages the interior surface 66 of the spacer ring 58 in a tapered engagement therebetween. It should be appreciated that the tapered engagement between the outer surface 66 of the brake pin 60 and the interior surface 66 of the spacer ring 58 may be achieved by configuring the outer surface 62 of the brake pin 60 and/or the interior surface 66 of the spacer ring 58 to include some other shape, such as but not limited to, a spherical shape.

Preferably, the taper angle 80 relative to the longitudinal axis 36 is between the range of 5 degrees and 15 degrees. More specifically, the taper angel 80 may be near 10 degrees. However, it should be appreciated that the taper angle 80 may vary from that disclosed in order to meet specific design requirements.

Figure 5:
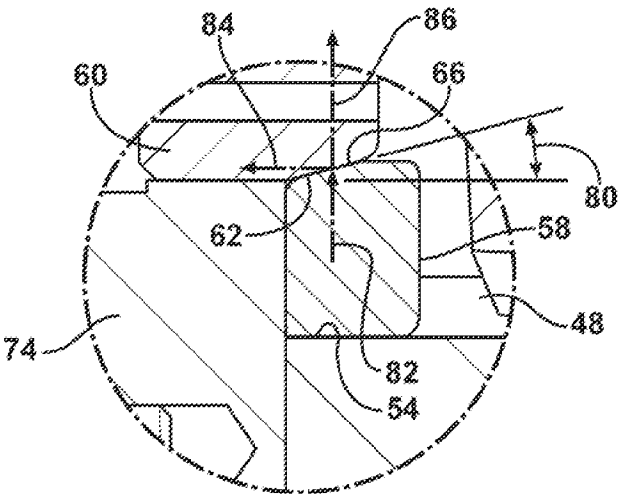
FIG. 5 is an enlarged schematic fragmentary cross sectional view of the rotary fluid pressure device showing a force diagram thereon.

Referring to FIG. 5, the tapered engagement between the brake pin 60 and the spacer ring 58 generates an axial force along the longitudinal axis 36 sufficient to compress the biasing device 78 and move the brake pin 60 into the unlocked position in response to a torque applied to the star gear 30 having a magnitude greater than a pre-defined value. Accordingly, an actuating torque applied to the star gear 30, generates a radial force 82 applied against the spacer ring 58 and directed radially inward toward the longitudinal axis 36. The spacer ring 58 transmits the radial force 82 to the brake pin 60 through the tapered engagement therebetween. The tapered engagement between the brake pin 60 and the spacer ring 58 breaks the radial force 82 from the star gear 30 into a resultant axial force component 84 and a resultant radial force component 86, with the resultant axial force component 84 directed along, i.e., parallel to, the longitudinal axis 36 and the resultant radial force component 86 directed radially inward toward the longitudinal axis 36. When the resultant axial force component 84 becomes larger than a resisting force supplied by the biasing device 78, the resultant axial force component 84 moves the brake pin 60 into the unlocked position. Accordingly, when the torque applied to the star gear 30 reaches a certain level, the brake pin 60 will automatically move into the unlocked position, thereby preventing any possible damage to either the brake pin 60 or the spacer ring 58 by overloading the star gear 30, i.e., providing a torque to the star gear 30 that is greater than an allowed operational torque.

The angle of the taper angle 80 determines the ratio between the resultant axial force component 84 and the resultant radial force component 86. The taper angle 80 is determined by several factors, including but not limited to, an expected external load, a maximum motor torque, material properties of the various components, etc. Increasing the taper angle 80 increases the resultant axial force component 84 and decreases the resultant radial force component 86. As such, increasing the taper angle 80 reduces the maximum overload level. Similarly, decreasing the taper angle 80 decreases the resultant axial force component 84 and increases the resultant radial force component 86. As such, decreasing the taper angle 80 increases the maximum overload level.

As described above, the taper angle 80 controls the torque level at which the overload torque automatically moves the brake pin 60 into the unlocked position. As such, the torque level at which the overload torque automatically moves the brake pin 60 is easily changeable by replacing the existing brake pin 60 and the existing spacer ring 58 with a new brake pin 60 and a new spacer ring 58 that defines a different taper angle therebetween.

While the best modes for carrying out the invention have been described in detail, those familiar with the art to which this invention relates will recognize various alternative designs and embodiments for practicing the invention within the scope of the appended claims.

The invention claimed is:

1. A rotary fluid pressure device comprising:

a housing;

a ring gear attached to said housing and defining an interior extending along a longitudinal axis, and including a plurality of internal teeth extending radially inward into said interior;

a star gear eccentrically disposed relative to said longitudinal axis within said interior of said ring gear for orbital movement about said longitudinal axis, said star gear including a plurality of external teeth extending radially outward into engagement with said internal teeth of said ring gear and defining an internal opening;

a spacer ring attached to said star gear and disposed within said internal opening of said star gear adjacent an end surface of said star gear for orbital movement with said star gear about said longitudinal axis;

a brake pin coupled to said housing and longitudinally moveable along said longitudinal axis between a locked position and an unlocked position with said brake pin in interlocking engagement with said spacer ring to prevent said orbital movement of said spacer ring and said star gear when in said locked position and said brake pin disengaged from said spacer ring to permit said orbital movement of said spacer ring and said star gear when in said unlocked position;

a biasing device coupled to said brake pin and configured for biasing said brake pin into said locked position;

said spacer ring including an interior surface extending along and angled relative to said longitudinal axis at a taper angle to define a frustoconical taper opening toward said brake pin; and said brake pin including an outer surface extending along and angled inward toward said longitudinal axis at said taper angle to define a frustoconical surface narrowing toward said spacer ring for engaging said interior surface of said spacer ring in a tapered engagement;

wherein said tapered engagement generates an axial force along said longitudinal axis sufficient to compress said biasing device and move said brake pin into said unlocked position in response to a torque applied to said star gear having a magnitude greater than a pre-defined value; and wherein said star gear includes a plurality of internal splines defining a spline diameter, with said outer surface of said brake pin being smaller than said spline diameter such that the outer surface of said brake pin is radially spaced from said internal splines of said star gear relative to said longitudinal axis.

2. A rotary fluid pressure device as set forth in claim 1 wherein said taper angle relative to said longitudinal axis is between the range of 5 degrees and 15 degrees.

3. A rotary fluid pressure device as set forth in claim 1 wherein said interior surface of said spacer ring defines an interior diameter less than said spline diameter.

4. A rotary fluid pressure device as set forth in claim 3 further comprising a shaft having a plurality of exterior splines in meshing engagement with said interior splines of said star gear.

5. A rotary fluid pressure device as set forth in claim 4 wherein said shaft defines a bore extending longitudinally through said shaft.

6. A rotary fluid pressure device as set forth in claim 5 further comprising a brake rod moveably disposed within said bore and including an end in abutting engagement within said brake pin, said brake rod configured for moving said brake pin between said locked position and said unlocked position.

7. A rotary fluid pressure device as set forth in claim 6 further comprising a valve body attached to said housing and configured for controlling the operation of said shaft and said brake rod.

8. A rotary fluid pressure device as set forth in claim 1 wherein said biasing device includes at least one spring.

9. A rotary fluid pressure device as set forth in claim 1 further comprising a gear cover coupled to said ring gear and configured for securing said ring gear and said star gear to said housing.

10. A rotary fluid pressure device as set forth in claim 9 further comprising a brake pin cover attached to said gear cover and securing said biasing device relative to said brake pin, with said biasing device biasing against said brake pin cover.

11. A rotary fluid pressure device as set forth in claim 9 wherein said internal opening of said star gear defines an annular notch disposed adjacent said end surface of said star gear, with said spacer ring disposed within said annular notch and secured between said plurality of internal splines of said star gear and said gear cover.

12. A rotary fluid pressure device comprising:

a housing;

a ring gear attached to said housing and defining an interior extending along a longitudinal axis, and including a plurality of internal teeth extending radially inward into said interior;

a star gear eccentrically disposed relative to said longitudinal axis within said interior of said ring gear for orbital movement about said longitudinal axis, said star gear including a plurality of external teeth extending radially outward into engagement with said internal teeth of said ring gear and defining an internal opening;

a spacer ring attached to said star gear and disposed within said internal opening of said star gear adjacent an end surface of said star gear for orbital movement with said star gear about said longitudinal axis;

a brake pin coupled to said housing and longitudinally moveable along said longitudinal axis between a locked position and an unlocked position with said brake pin in interlocking engagement with said spacer ring to prevent said orbital movement of said spacer ring and said star gear when in said locked position and said brake pin disengaged from said spacer ring to permit said orbital movement of said spacer ring and said star gear when in said unlocked position;

a biasing device coupled to said brake pin and configured for biasing said brake pin into said locked position;

said spacer ring including an interior surface extending along and angled relative to said longitudinal axis at a taper angle to define a frustoconical taper opening toward said brake pin; and said brake pin including an outer surface extending along and angled inward toward said longitudinal axis at said taper angle to define a frustoconical surface narrowing toward said spacer ring for engaging said interior surface of said spacer ring in a tapered engagement;

wherein said star gear includes a plurality of internal splines defining a spline diameter, with said interior surface of said spacer ring defining an interior diameter that is less than said spline diameter, and with said outer surface of said brake pin being smaller than said spline diameter such that the outer surface of said brake pin is radially spaced from said internal splines of said star gear relative to said longitudinal axis; and wherein said tapered engagement generates an axial force along said longitudinal axis sufficient to compress said biasing device and move said brake pin into said unlocked position in response to a torque applied to said star gear having a magnitude greater than a pre-defined value.

13. A rotary fluid pressure device as set forth in claim 12 wherein said taper angle relative to said longitudinal axis is between the range of 5 degrees and 15 degrees.

14. A rotary fluid pressure device as set forth in claim 13 further comprising a shaft having a plurality of exterior splines in meshing engagement with said interior splines of said star gear.

15. A rotary fluid pressure device as set forth in claim 14 wherein said shaft defines a bore extending longitudinally through said shaft.

16. A rotary fluid pressure device as set forth in claim 15 further comprising a brake rod moveably disposed within said bore and including an end in abutting engagement within said brake pin, said brake rod configured for moving said brake pin between said locked position and said unlocked position.

17. A rotary fluid pressure device as set forth in claim 16 further comprising a valve body attached to said housing and configured for controlling the operation of said shaft and said brake rod.

18. A rotary fluid pressure device as set forth in claim 12 further comprising a gear cover coupled to said ring gear and configured for securing said ring gear and said star gear to said housing.

19. A rotary fluid pressure device as set forth in claim 18 further comprising a brake pin cover attached to said gear cover and securing said biasing device relative to said brake pin, with said biasing device biasing against said brake pin cover.

20. A rotary fluid pressure device as set forth in claim 19 wherein said internal opening of said star gear defines an annular notch disposed adjacent said end surface of said star gear, with said spacer ring disposed within said annular notch and secured between said plurality of internal splines of said star gear and said gear cover.

* * * * *